US005176536A

United States Patent [19]

Ganger et al.

[11] Patent Number: 5,176,536

[45] Date of Patent: Jan. 5, 1993

[54] RIGHT ANGLE PHONE PLUG

[75] Inventors: Robert P. Ganger, Sturgis; Glen C. Back, Climax, both of Mich.

[73] Assignee: G & H Industries, Mendon, Mich.

[21] Appl. No.: 715,490

[22] Filed: Jun. 14, 1991

[51] Int. Cl.[5] ..... H01R 13/00

[52] U.S. Cl. ..... 439/582

[58] Field of Search ..... 439/578-585, 439/665, 668, 669

[56] References Cited

U.S. PATENT DOCUMENTS

| | | | |
|---|---|---|---|
| 2,238,834 | 4/1941 | Travers | 439/669 |
| 2,933,714 | 4/1960 | Overholser | 439/582 |
| 2,952,823 | 9/1960 | Robinson | 439/582 |

OTHER PUBLICATIONS

Switchcraft Short Form Catalog, p. 70 (1985).

Switchcraft Catalog P202d, *Plugs and Patch Cords*, p. 7 (1984).

*Primary Examiner*—Joseph H. McGlynn

*Attorney, Agent, or Firm*—Howard S. Robbins

[57] ABSTRACT

An angle connected phone plug (10) for connection to a coaxial electrical cable (11) without screws or other mechanisms includes a tip and wire assembly (20), a housing assembly (40) and a terminal assembly (60), all disposed coaxially along longitudinal axis (100) of phone plug (10), and a substantially cylindrically shaped barrel (80) having its own longitudinal axis 110 along which coaxial electrical cable (11) enters phone plug (10). The housing assembly (40) includes a housing base (41) and a mating housing cap (42), which when mated present a threaded neck (49) at an angle to longitudinal axis (100). Barrel (80) is coupled to threaded neck (49), thereby securing the housing assembly (40) closed.

5 Claims, 3 Drawing Sheets

RIGHT ANGLE PHONE PLUG

TECHNICAL FIELD

The present invention relates generally to phone plugs for the establishment of temporary electrical connections. More particularly, the present invention relates to inexpensive phone plugs configured to establish mechanically strong and reliable, highly electrically conductive connections to coaxial electrical cable conductors entering the plug at a ninety degree (90°) (i.e., right) angle to the longitudinal axis of the phone plug.

BACKGROUND ART

Phone plugs have long been used for the establishment of temporary electrical connections in a wide variety of industries and applications, such as music and audio. Occasionally space and geometry constraints require that conductors to be electrically connected by phone plug enter the phone plug at a ninety degree (90°) (i.e., right) angle to the longitudinal axis of the phone plug. Historically right angle phone plugs consisted of the tip, ring and sleeve stem connected perpendicularly to a stamped, flat base plate, such as the line of "Flat-Plug" Phone Plugs (Models Series 22X and 23X) manufactured by Switchcraft Incorporated of Chicago, Ill. A second stamped or plastic molded cover plate was screwed onto the flat base plate to provide a housing within which screw or solder connections were made to the conductors.

Such right angle phone plugs were more expensive to manufacture and assemble than conventional straight phone plugs, and more likely to fail mechanically due to the nature of the right angle connection between the stem and flat base plate. Additionally, such right angle phone plugs were more time consuming and therefor expensive to assemble due to the need to make multiple screw connections between the cover plate and the flat base plate.

SUMMARY OF THE INVENTION

It is, therefore, an object of the present invention to provide a phone plug where the conductors to be electrically connected enter the phone plug at some substantial angle (such as at a right angle) to the longitudinal axis of the phone plug in such manner as to facilitate inexpensive, efficient connection to the desired conductors.

It is another object of the present invention to provide an angle connected phone plug, as set forth above, which enhances the mechanical strength of the connection between its stem and the housing within which are connected the desired conductors.

It is still another object of the present invention to provide a right angle phone plug wherein there is no need for screws or other independent mechanism to secure the phone plug housing, and no need for tools to assist in securing the phone plug housing.

These and other objects and advantages of the present invention over existing prior art forms will become more apparent and fully understood from the following description in conjunction with the accompanying drawings.

In general, a phone plug having a longitudinal axis for electrical connection of an electrical cable at an angle to the longitudinal axis includes terminal means for electrical engagement with the electrical cable, means for electrical engagement with a phone jack, the means for electrical engagement with a phone jack electrically connected to the terminal means; housing means for carrying the terminal means and the means for electrical engagement with a phone jack and receiving the electrical cable. The housing means including neck means for receiving the electrical cable, the neck means at the angle to the phone plug longitudinal axis, and barrel means for coupling to the neck means and furnishing a handle at the angle to the phone plug longitudinal axis, the barrel means receiving the electrical cable.

PREFERRED EMBODIMENT FOR CARRYING OUT THE INVENTION

Figure 1:
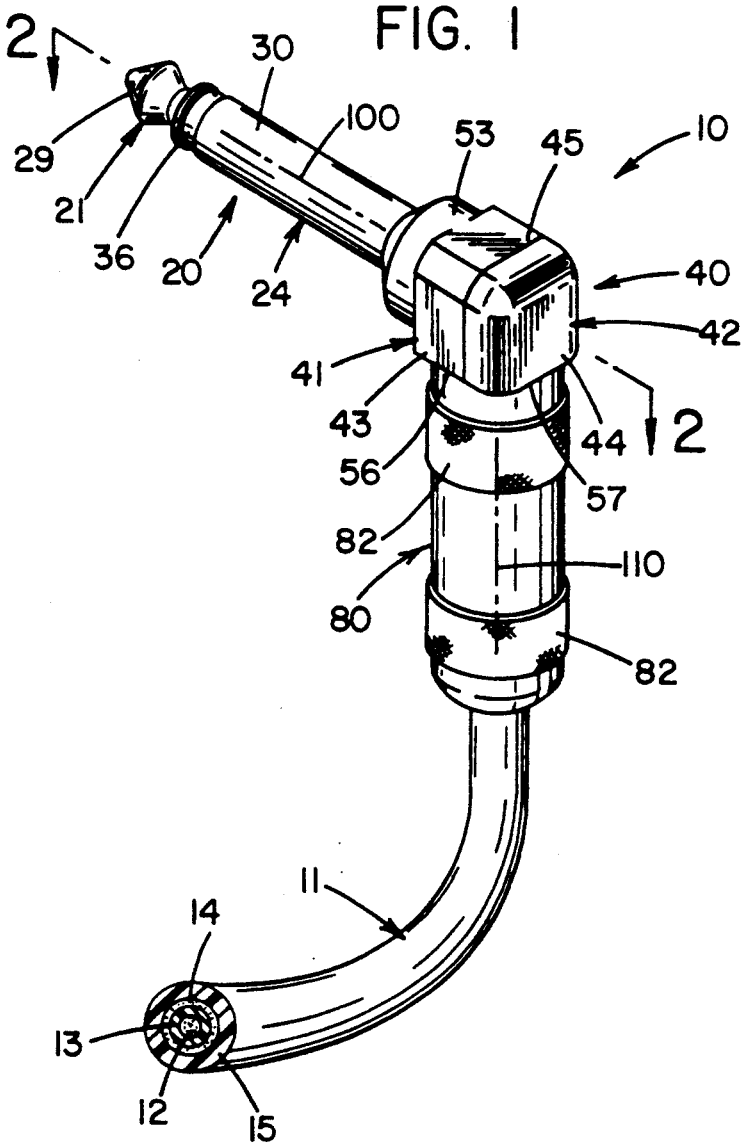
FIG. 1 presents a perspective view of an assembled, exemplary right angle phone plug in accordance with the present invention connected to a two-conductor coaxial cable.

FIG. 1 depicts a perspective view of an exemplary, two-conductor right angle phone plug, generally indicated by the reference numeral 10, in accordance with the present invention. Phone plug 10 permits establishment of temporary electrical connections with a multiple conductor cable such as a conventional two-conductor coaxial cable 11 having a center conductor 12 along its longitudinal axis, a cylindrically shaped insulative separator 13 coaxially disposed around center conductor 12, a cylindrically shaped shield conductor 14 coaxially disposed around separator 13, and an insulative outer jacket 15.

Figure 5:
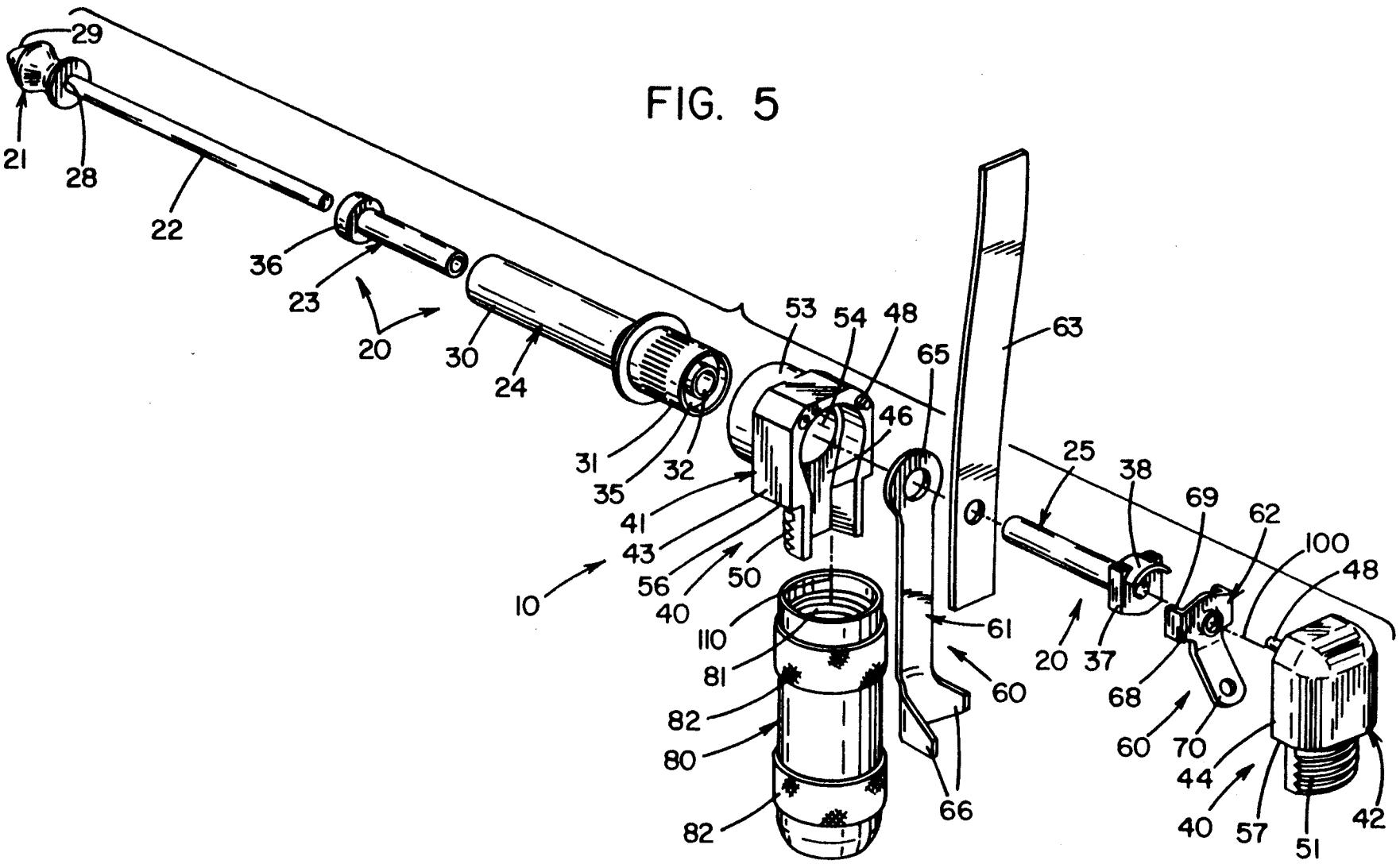
FIG. 5 presents an exploded perspective view of the components of the exemplary right angle phone plug depicted in FIG. 1 and their relationship.

As perhaps best seen in the exploded perspective view of FIG. 5, phone plug 10 includes a tip and wire assembly 20, a housing assembly 40 and a terminal assembly 60, all disposed coaxially along longitudinal axis 100 of phone plug 10 in the manner described more fully hereinafter, and a substantially cylindrically shaped shell or barrel 80 having its own longitudinal axis 110 along which coaxial cable 11 enters phone plug 10.

Figure 2:
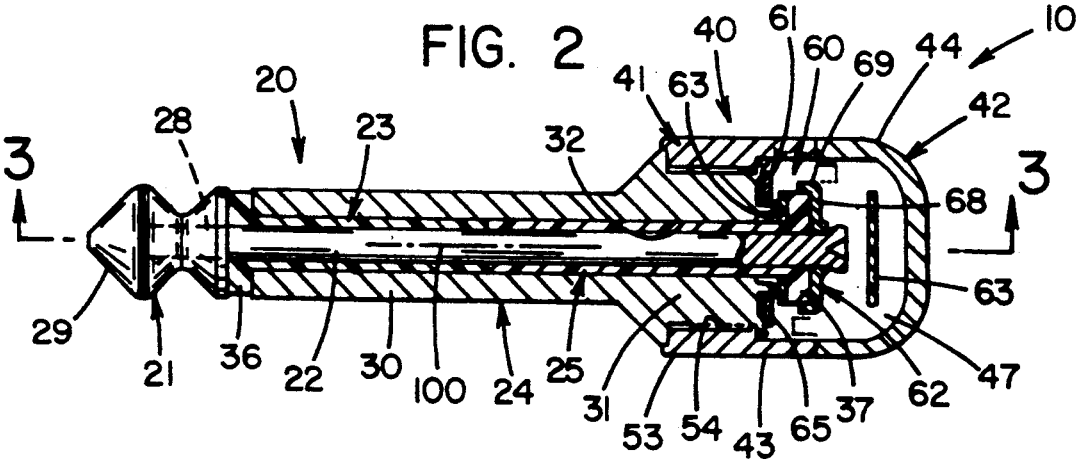
FIG. 2 presents a horizontal section of the right angle phone plug depicted in FIG. 1 taken substantially along the line of 2—2 shown in FIG. 1, the longitudinal axis of the stem.

Tip and wire assembly 20 may include a knob tip 21 furnishing the tip conductor electrical connection to the phone jack receiving phone plug 10, wire 22, tip insulator 23, stem 24 furnishing the sleeve conductor electrical connection to the phone jack, and a terminal insulator 25. Knob tip 21 may be shaped to enhance mating engagement with a conventional phone jack and made preferably of suitable mechanically strong, electrically conductive material such as bright nickel plated brass. Wire 22, which may be made of any suitable electrical conductive material such as copper, may be inserted through a bore 28 in knob tip 21 and have its end proximate thereto tapered to a rounded point 29 as seen in FIG. 2.

Stem 24, which also may be formed of a suitable mechanically strong, conductive material such as bright nickel plated brass, is preferably integrally made into two substantially cylindrical portions including sleeve 30 having the standard outer diameter for phone plugs which is flared into a somewhat larger diameter base 31 whose exterior may be knurled or otherwise formed to enhance its interference fit with housing assembly 40 as detailed below. Stem 24 includes a bore 32 along its longitudinal axis to receive tip insulator 23 and terminal insulator 25 as further detailed below. An annular groove 35 is formed in the end of base 32 opposite sleeve 30.

Tip insulator 23 is a sleeve that electrically insulates knob tip 21 and wire 22 from stem 24, and may be formed of any suitable insulator material such as Allied 8253 Nylon. In the exemplary embodiment shown in the Figures, tip insulator 23 is made to have an outer diameter which fits snugly within a portion of the bore 32 interior of sleeve 30 and an inner diameter which fits snugly over wire 22. A concentric flange 36 may be formed at one end of tip insulator 23 to preclude electrically conductive engagement between knob tip 21 and sleeve 30.

Terminal insulator 25 is a sleeve that insulates wire 22 and terminal assembly 60 from stem 24. Terminal insulator 25, similar to tip insulator 23 may be formed of any suitable insulator material such as Allied 8253 Nylon, and is made to have an outer diameter which fits snugly within a portion of the interior of sleeve 30 and an inner diameter which fits snugly over wire 22. A rectangular block base 37 may be formed at one end of terminal insulator 25 and an arcuate arm 38 extended from one side of base 37 to support a portion of terminal assembly 60 as noted below and preclude electrically conductive engagement between the supported portion of terminal assembly 60 and any other portion of phone plug 10.

Housing assembly 40 includes a (lower-half housing or) housing base 41 and a mating (upper-half housing or) housing cap 42, each of which may be formed such as by casting of any suitable mechanically strong, electrically conductive material such as zinc die cast alloy #3. Housing base 41 and housing cap 42 each have its own rectangular central portion 43, 44, respectively, which when mated form a somewhat cubic central portion 45 (FIG. 1). The exterior edges of housing cap 42 may be rounded to provide greater tactile attractiveness.

The interior of rectangular central portions 43, 44 include chambers 46 (FIG. 5), 47 (FIGS. 2 and 3), respectively to receive coaxial cable 11 and terminal assembly 60 and allow connection therebetween in a manner further detailed hereinbelow. Alignment pins 48 and their corresponding receiving wells may be cast into central portions 43, 44 to facilitate mating engagement.

Extending from one face of the somewhat cubic central portion 45 of housing assembly 40 is a threaded neck 49 (FIG. 3) split between threaded neck halves 50, 51 of housing base 41 and housing cap 42, respectively. A small portion of threaded neck 49 is truncated along opposite faces of central portion 45, and threaded neck 49 may be positioned to allow shoulders 56, 57 (best seen in FIG. 3) between threaded neck halves, 50, 51 and the edge of central portions 43, 44, respectively.

Also extending from a face of the rectangular central portion 43 of housing base 41 at a right angle to the face from which extends threaded neck half 50 is a cylindrical base 53. The height of cylindrical base 53 and the inside diameter of bore 54 therein are adapted to receive base 31 of stem 24 and allow annular groove 35 in base 32 of stem 24 to extend within chamber 46.

Terminal assembly 60 incudes a ground clip 61, center clip 62 and insulator strip 63. Ground clip 61 and center clip 62 may be formed of a suitable mechanically strong, conductive material such as bright nickel plated brass, while insulator strip 63 may be formed of any suitable insulator material such mylar. Ground clip 61 includes an eyelet portion 65 and strain relief tabs 66 at opposite ends thereof. Center clip 62 includes a substantially rectangular central portion 68 having side flanges 69 for mating engagement with the sides of rectangular block base 37 in terminal insulator 25, and a solder tab 70 to which center conductor 12 may be soldered. Insulator strip 63 includes a hole through which wire 22 may pass positioned such that insulator strip electrically insulates center clip 62 and the center conductor 12 connected thereto from the remainder of phone plug 10.

Barrel 80, which may be formed of a suitable mechanically strong, conductive material such as bright nickel plated brass, includes threading 81 interior to and recessed within one end thereof such that barrel 80 may be screwed onto the mated housing base 41 and housing cap 42 until that end of barrel 80 contacts shoulders 56, 57. Manual frictional engagement with the exterior of barrel 80, which acts as a handle, may be enhanced such as by the inclusion of one of more areas of knurling 82.

Assembly of phone plug 10 is straightforward, and may begin with inserting wire 22 through knob tip 21, forming that end of wire 22 into rounded point 29 and slipping tip insulator 23 over the other end of wire 22. Base 31 of stem 24 is inserted into the cylindrical base 53 of housing assembly 40, and the outer wall defining annual groove 35 stamped over onto the floor of chamber 46, thereby fixedly securing stem 24 to housing base 41. Eyelet 66 of ground clip 61 is placed over the inner wall defining annual groove 35, and that wall stamped over onto ground clip 61, fixedly securing ground clip 61 to housing base 41.

Next, wire 22 with knob tip 21 and tip insulator 23 thereon is inserted into stem 24 until concentric flange 36 contacts stem 24 whereupon the free end of wire 22 extends within chamber 46. Insulator strip 63 is placed over wire 22 by passing wire 22 through the hole therein such that the shorter end of insulator strip 63 rests atop the portion of ground clip 61 within chamber 46. Thereafter tip insulator 23 is slid over the end of wire 22 extending into chamber 46 such that arm 38 is adjacent the closed end of chamber 46, tip insulator 23 thereby passing through insulator strip 63 and eyelet 66.

Figure 3:
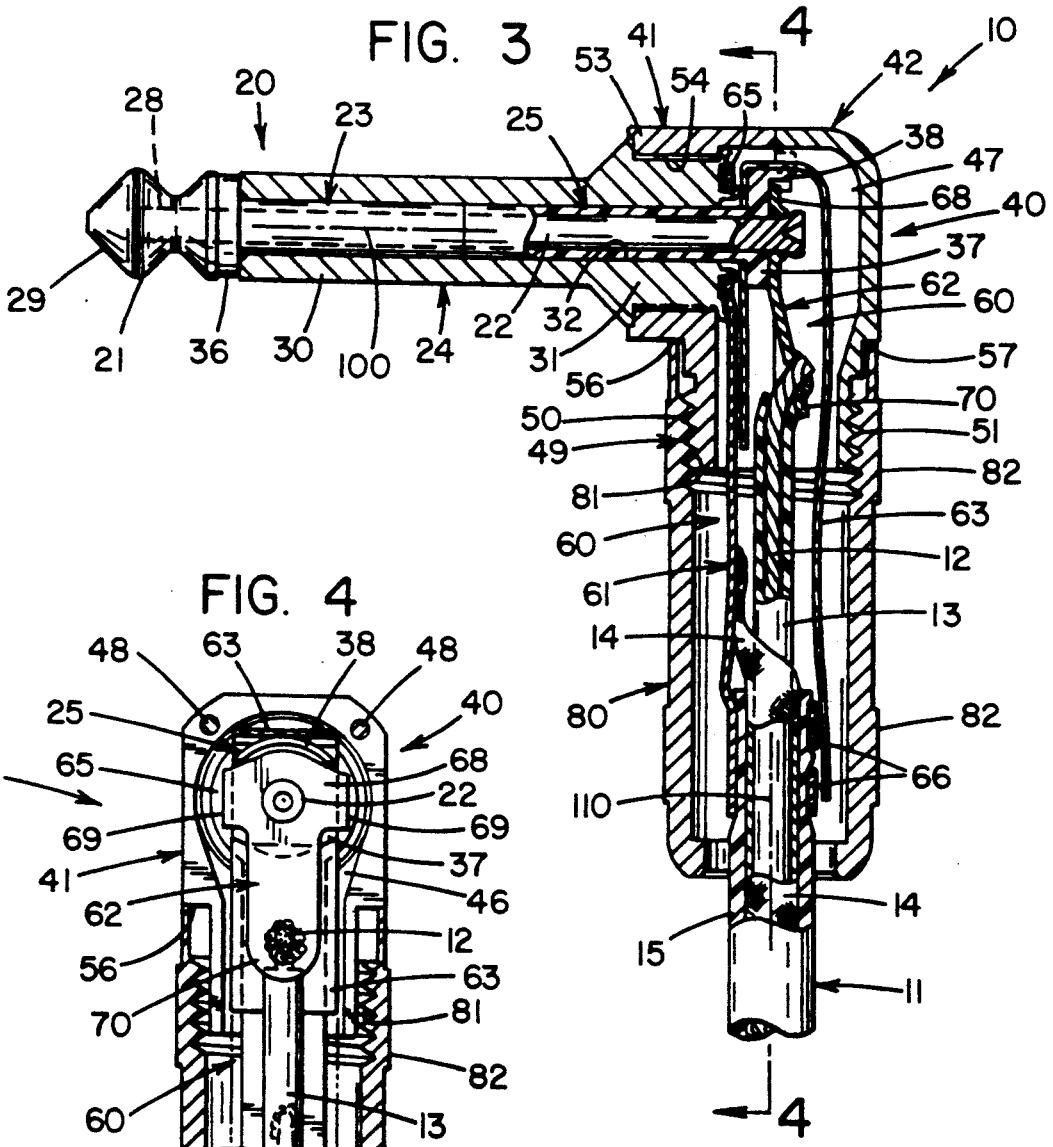
FIG. 3 presents an elevational section of the entire right angle phone plug depicted in FIG. 1 taken substantially along the line of 3—3 shown in FIG. 2.
Figure 4:
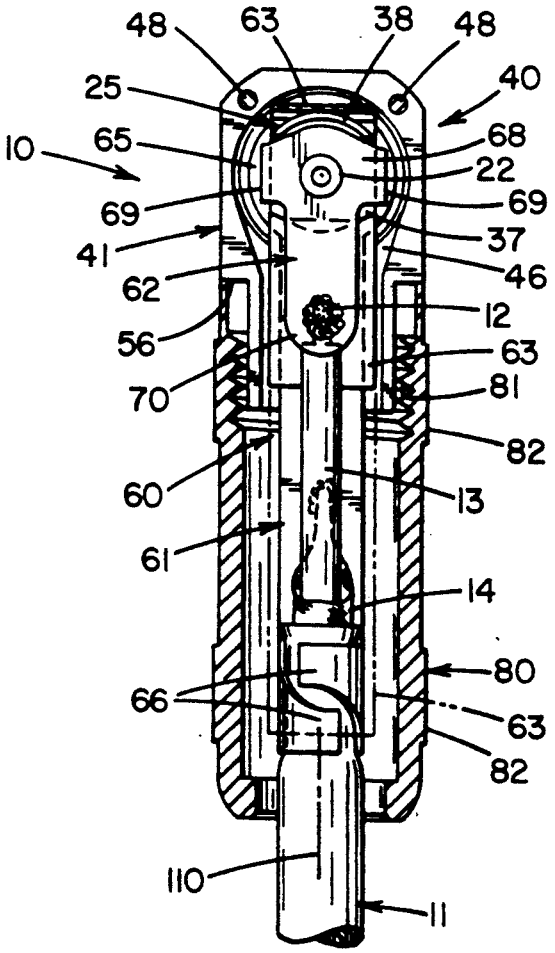
FIG. 4 presents an elevational section of the right angle phone plug depicted in FIG. 1 taken substantially along the line of 4—4 shown in FIG. 3, the longitudinal axis of the barrel.

Once tip insulator is in place, center clip 22 may be positioned ov the rectangular block base 37 of terminal insulator 25 such that wire 22 passes through a hole therein, solder tab 70 extends into the portion of chamber 46 interior of threaded neck half 50, and flanges 69 extend over the sides of rectangular block base 37. At this juncture the exposed end of wire 22 may be center-punched, which because of its ductile nature will cause the end of wire 22 expand to extend over ground clip 62 (as best shown in FIGS. 2, 3 and 4), thereby securing the entire assembly. This completes manufacture assembly, leaving three components for final assembly upon connection of phone plug 10 to coaxial cable 11: barrel 80, housing cap 42 and the assembled remainder of phone plug 10.

Attachment of phone plug 10 to coaxial cable 11 is initiated by placing the end of coaxial cable 11 to be connected to phone plug 10 through barrel 80 beginning with the non-threaded end and insuring coaxial cable 11 is in condition for connection. Coaxial cable 11 is prepared by cutting back outer jacket 15 a distance that allows a substantial electrical engagement of center conductor 12 to solder tab 70 while at the same time extending the outer jacket just past strain relief tabs 66, as most effectively shown in FIGS. 3 and 4. A small section of separator 13 may be removed, and in the conventional manner center conductor 12 soldered to tab 70, shield conductor 14 soldered to ground clip 61 and strain relief tabs secured over outer jacket 15. Alternatively, phone plug 10 may be provided with any of the well known solderless connections such as screw terminals.

The free end of insulator strip 63 is held down over the coaxial cable 11 connections and barrel slid thereover and screwed onto threaded neck 49 until the end of barrel 80 butts against shoulders 56 and 57, completing connection of phone plug 10.

The skilled artisan should now appreciate that by forming housing base 41 and housing cap 42 such that threaded neck 49 extends therefrom at different angles, the phone plug of the instant invention may be preselected to have a wide variety of angles between the longitudinal axes of the stem and connected cable. It should also be appreciated that barrel 80 may be formed of a suitable mechanically strong, non-conductive material such as a plastic, and that when made of such material barrel 80 may either include threads for engagement with threaded neck 49, or may be adapted for snap-on interlock to threaded neck 49 or reliefs formed in housing assembly 40.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that a device constructed and method performed according to the concept of the present invention, and reasonably equivalent thereto, will accomplish the objects of the present invention and otherwise substantially improve the art of angle phone plug manufacture and assembly.

We claim:

1. A phone plug having a longitudinal axis for electrical connection of an electrical cable at an angle to the longitudinal axis, comprising:

terminal means for electrical engagement with the electrical cable;

means for electrical engagement with a phone jack, said means for electrical engagement with a phone jack electrically connected to said terminal means;

housing means for carrying said terminal means and said means for electrical engagement with a phone jack and receiving the electrical cable, said housing means including neck means for receiving the electrical cable, said neck means at the angle to the phone plug longitudinal axis; and, barrel means for coupling to said neck means and furnishing a handle at the angle to the phone plug longitudinal axis, said barrel means receiving the electrical cable, said housing means including first housing means for carrying the entire said terminal means and the entire said means for electrical engagement with a phone jack, and including a first partial neck means for coupling to said barrel means, and, second housing means for mating with said first housing means and including a second partial neck means for coupling to said barrel means, said barrel means coupling to said first partial neck means and said second partial neck means after mating, said first housing means and said second housing means being matingly coupled and held securely together solely by engagement of said first partial neck means and said second partial neck means by said barrel means.

2. A phone plug, as set forth in claim 1, wherein said first partial neck means includes exterior partial threading, said second partial neck means includes exterior partial threading and said barrel means includes interior partial threading, said barrel means includes means for threaded engagement with said mated said first partial neck means and said second partial neck means.

3. A phone plug, as set forth in claim 2, wherein said first housing means carries the entire said means for electrical engagement with a phone jack along the phone plug longitudinal axis and the angle is a right angle to the phone plug longitudinal axis.

4. A phone plug, as set forth in claim 2, wherein the electrical cable is a coaxial cable having at least a center conductor and a shield conductor, said means for electrical engagement with a phone jack includes tip means for electrical engagement with said center conductor and sleeve means for engagement with said shield conductor.

5. A phone plug, as set forth in claim 4, wherein said first housing means is a housing base and said second housing means is a housing cap.

* * * * *